US007364324B2

(12) United States Patent
De Sisti

(10) Patent No.: US 7,364,324 B2
(45) Date of Patent: Apr. 29, 2008

(54) DISCHARGE LAMP HAVING INTEGRATED BALLAST SUPPORT

(75) Inventor: Mario De Sisti, Albano Laziale (IT)

(73) Assignee: De Sisti Lighting S.p.A., Albano Laziale (RM) (IT)

( * ) Notice: Subject to any disclaimer, the term of this patent is extended or adjusted under 35 U.S.C. 154(b) by 0 days.

(21) Appl. No.: 10/946,110

(22) Filed: Sep. 22, 2004

(65) Prior Publication Data

US 2005/0036316 A1 Feb. 17, 2005

Related U.S. Application Data

(63) Continuation of application No. 10/318,043, filed on Dec. 13, 2002, now abandoned.

(30) Foreign Application Priority Data

Dec. 21, 2001 (IT) ..... RM2001A0757

(51) Int. Cl.
*F21V 21/26* (2006.01)

(52) U.S. Cl. ..... 362/269; 362/426; 362/430; 362/265; 362/294

(58) Field of Classification Search ..... 362/263, 362/265, 294, 419, 426, 430, 269
See application file for complete search history.

(56) References Cited

U.S. PATENT DOCUMENTS

| | | | | | |
|---|---|---|---|---|---|
| 407,914 | A * | 7/1889 | Wood | 362/324 |
| 2,997,574 | A * | 8/1961 | Miskella | 362/264 |
| 3,895,227 | A * | 7/1975 | Murray et al. | 362/294 |
| 3,919,459 | A * | 11/1975 | Van Steenhoven | 362/368 |
| 4,164,784 | A * | 8/1979 | Jaksich | 362/282 |
| 4,190,881 | A * | 2/1980 | Drost et al. | 362/263 |
| 4,460,948 | A | 7/1984 | Malola | 362/396 |
| 4,556,936 | A | 12/1985 | Snow | 362/371 |
| 4,701,833 | A * | 10/1987 | Bornhorst | 362/294 |
| 4,750,096 | A | 6/1988 | Lim | 362/218 |
| 5,136,490 | A * | 8/1992 | Morrison | 362/294 |
| 5,183,331 | A * | 2/1993 | Edgell et al. | 362/426 |
| 5,586,015 | A * | 12/1996 | Baldwin et al. | 362/263 |
| 5,665,305 | A | 9/1997 | Belliveau et al. | 362/268 |
| 5,820,252 | A | 10/1998 | Finch | 362/265 |
| 6,174,074 | B1 | 1/2001 | Lahijani | 362/264 |
| 6,196,705 | B1 * | 3/2001 | Finke et al. | 362/276 |
| 6,390,655 | B1 * | 5/2002 | Haugaard et al. | 362/265 |
| 6,561,676 | B1 * | 5/2003 | Fischer et al. | 362/263 |

FOREIGN PATENT DOCUMENTS

| | | |
|---|---|---|
| EP | 0 061 601 | 10/1982 |

* cited by examiner

*Primary Examiner*—Ismael Negron
(74) *Attorney, Agent, or Firm*—Arent Fox LLP

(57) ABSTRACT

An integrated projector for discharge lamps includes a projector, having a discharge lamp, and a support fork shaped structure for the projector. The fork shaped structure provides two substantially vertical elements, provided laterally with respect to the projector, and a horizontal arm, joining the lateral elements. In the substantially vertical elements of the fork shaped structure are provided the elements of a voltage limiting system, or ballast. Through the horizontal arm passes the electrical connection cables of the various components of the ballast provided in the two substantially vertical elements. A power supply is provided between one of the substantially vertical elements of the fork shaped structure and the projector electrical connection.

7 Claims, 2 Drawing Sheets

DMX IN
FUSE
LOC./REM.
DMX OUT
MAINS BREAKER
ON/OFF
FUSE
DIMMER
DISPLAY
A
11

15
180° ROTATED
C
C
PFC BOARD
14

MAINS CABLE
A
Rear View

MAINS CABLE
C
B
Front View

B
MAINS FILTER
CHOPPER+ INVERTER BOARD
13

DISCHARGE LAMP HAVING INTEGRATED BALLAST SUPPORT

This application is a continuation of 10/318,043 filed Dec. 13, 2002 which is based upon and claims the benefit of priority from Italian Patent Application No. RM2001A000757 filed on Dec. 21, 2001. The entire contents of the application is incorporated herein by reference.

BACKGROUND OF THE INVENTION

1. Field of the Invention

The present invention relates to an integrated projector for discharge lamps.

More specifically, the invention concerns a projector of the above kind that integrates in a single unit both a real projector and a ballast, thus avoiding the need to provide an interconnection multipolar cable.

2. Description of Related Art

In the lighting engineering field, discharge lamps (halide vapours) have been widely used for many years. The lamps provide significant advantages with respect to traditional incandescent lamps (filament lamps). Advantages include luminous efficiency (lumen:watt) three or four times higher than that which can be obtained with filament lamps (some kinds of discharge lamps can reach almost a 100 lumen:watt ratio, while filament lamps, at most, have a luminous efficiency of 35 lumen:watt); a day light emission spectrum with a colour temperature between 4500 and 6500° K (Kelvin degrees), while filament lamps emit a spectrum with colour temperature at most of 3400° K. Chromatic features of the light emitted by discharge lamps are optimum in open environments, where there is already abundant solar light, since these features are calorimetrically compatible with daylight. In this way, colour correction or balancing intervention is easier, the intervention being necessary to obtain optimum results when telecameras or motion-picture cameras are used as reading instruments, or for the pleasure of the image perception by the human eye.

Furthermore, the use of discharge lamps allows a luminance up to 20 times higher than that of the filament lamps, making it possible to approach a punctiform light source, to optimise the optical system performances.

The professional lighting market has well received these types of products which debuted at the beginning of the 1970s, and are now considered a standard system.

For the use and the proper operation of the discharge lamps, it is necessary to have a system that strikes the voltaic arc when the lamp is switched on (an igniter), and a voltage limitation system (a ballast).

At present, lighting systems are comprised of the following elements:

- a projector comprising the optical system, the lamp and the igniter;
- a ballast, comprising the voltage limitation system and a series of electromechanical devices protecting the system in case of de-coupling between the projector and the ballast;
- an interconnection cable between the projector and the ballast, comprising a very flexible multipolar cable to prevent breakage problems that frequently occur in the inner conductors, and two multipin connectors respectively placed in the projector and in the ballast.

Usually, choice criteria by the users of the discharge projectors presently available on the market are based on the following factors:

- fixed costs of the material market products;
- use of variable costs, such as, lamp duration (hour cost), energy-saving in view of the higher luminous efficiency and thus reduced power employed with respect to the filament lamps, electric distribution and arrangement costs;
- reliability;
- apparatus performances;
- multiuse (possibility of use for more than one application).

As discussed above, powering systems for discharge lamps are presently comprised of a voltage limiting device (a ballast) comprised within a suitably dimensioned metallic housing, and a projector housing the lamp, the optical system and the switching-on device (igniter).

The structure realised in this way has a series of problems well-known to the users, such as the interconnection multipolar cable maximum length between the projector and the ballast (limited to 100 meters by most manufacturers), the high cost of the interconnection systems, the use of forced ventilation for cooling the ballast since the ballasts are usually laid on the ground when in use, and increase noise, etc.

These problems are presently solved either by adding various protection devices to the elements comprising the system (with a significant increase in cost, weight and dimensions), or by the experienced users who, knowing the limits imposed by the presently available systems, conform the arrangement respecting said constraints, often increasing costs, reducing the speed and efficiency of the installation.

SUMMARY OF THE INVENTION

The solution, as proposed according to the present invention, requires an integrated projector having advantages both in terms of fixed costs and of variable costs, as well as in reliability and the possibility of multiple uses.

These and other results are obtained according to the present invention by a solution of providing the integration in a single apparatus of all the elements necessary for the proper operation of the discharge lamps (projector, ballast and interconnection cables), without the need for dedicated distribution systems.

The solution suggested according to the present invention allows a suitable sizing of the ballast that also has the function of supporting the housing of the lamp, igniter and optical system and consequently does not need to take into consideration different lengths of the interconnection cables with the projector since the ballast is mounted contacting the projector. As a result, the electromagnetic compatibility of the whole apparatus is noticeably improved.

Furthermore, the solution according to the present invention avoids the passage of square wave forms on long cables. As a result, installations are easier and use of this kind of apparatus is simplified.

In the present invention, an integrated projector for discharge lamps comprises a projector, including a discharge lamp, and a support fork-shaped structure for the projector. The fork-shaped structure provides two substantially vertical elements, disposed laterally with respect to the projector. A horizontal arm joins the lateral elements in the substantially vertical elements of the fork-shaped structure and is provided with all the elements of a voltage limiting system, or ballast. The horizontal arm houses the electrical connection cables of the various components of the ballast provided in the two substantially vertical elements. A power supply is disposed between one of the substantially vertical elements of the fork-shaped structure and the projector electrical connection means.

According to the present invention, a radiator element is provided for cooling the device and is disposed laterally with respect to said two substantially vertical elements.

The present invention includes a projector switching on/off button.

The present invention includes an outward shielding.

The present invention includes an input circuit having a power factor correction.

The present invention includes elements of the fork-shaped structure provided with a quick coupling system, for coupling and de-coupling the elements from the projector.

BRIEF DESCRIPTION OF THE DRAWINGS

The present invention will be now described, for illustrative but not limitating purposes, according to one preferred embodiment of the invention, with particular reference to.

DETAILED DESCRIPTION OF THE INVENTION

Figure 1:
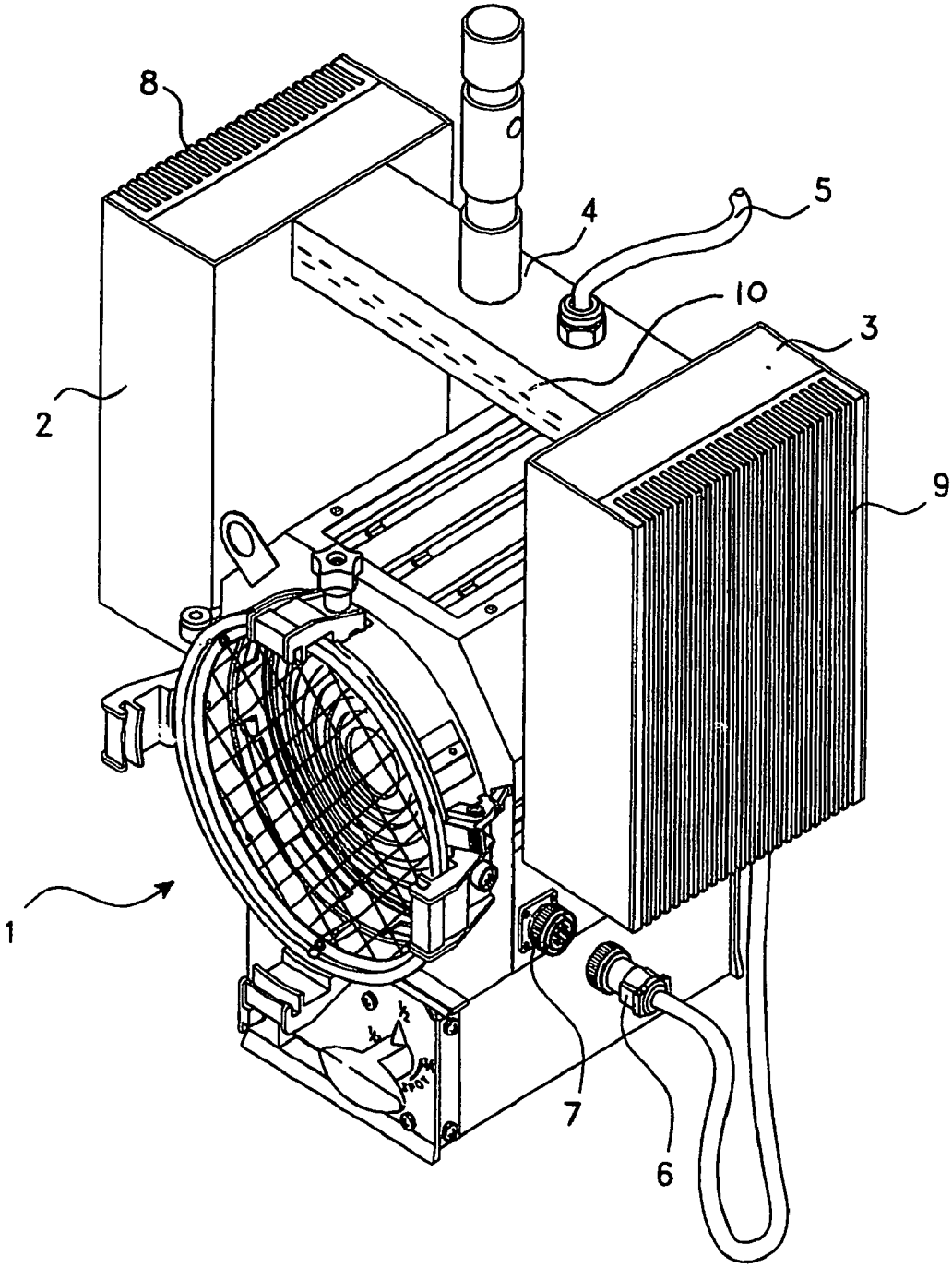
FIG. 1 showing a perspective view of a preferred embodiment of an integrated projector according to the invention.

FIG. 1 illustrates an embodiment of an integrated projector according to the invention, providing a discharge type projector 1 that, as discussed above, can be of any kind and power.

A fork-shaped structure is mounted on the projector 1, the fork-shaped structure comprising two vertical elements 2, 3, which include all the components of a standard ballast, and an upper connection arm 4, housing the electrical connection cables 10, and the main power supply 5.

Between vertical element 3 of the ballast and the projector 1, a power connector 6 is provided for coupling with the connector 7 of the projector 1 to the ballast.

Two lateral radiators 8, 9 are provided on both vertical elements 2 and 3.

As discussed above, it is possible to realize said solution for different kinds of projectors, such as, 125 W, 200 W, 400 W, 575 W, 1200 W, 2500 W, 4000 W, 6000 W, and 12000 W projectors, and, in any case, for each discharge lamp presently available on the market or that will be put on the market in the future.

Figures 2A, 2B, 2C, 2D, 2E:
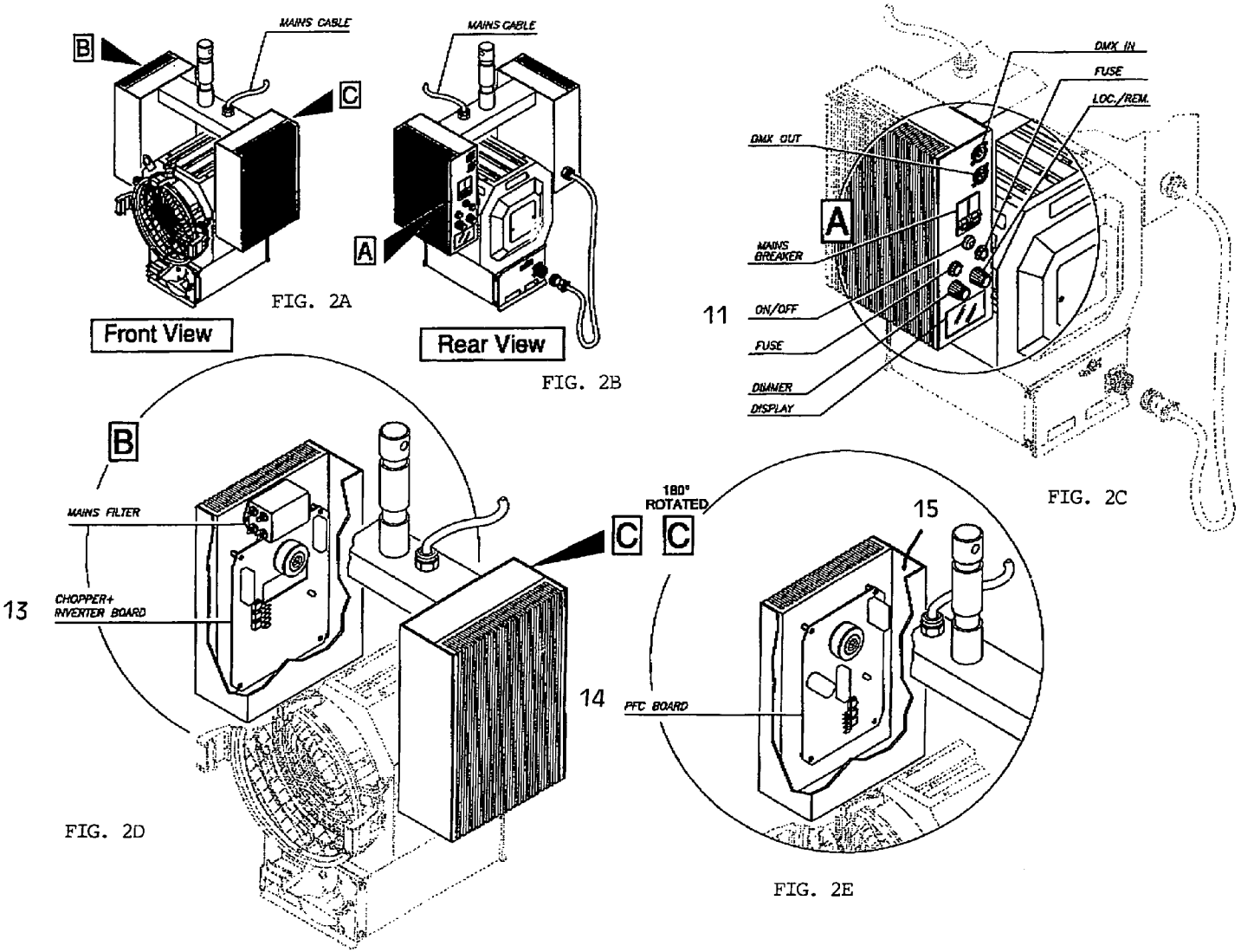
FIG. 2A illustrating a front perspective view of the integrated projector according to the invention and also identifying enlarged views.
FIG. 2B illustrating a rear perspective view of the integrated projector according to the invention and also identifying enlarged views.
FIG. 2C illustrating an enlarged view off the vertical element of the integrated projector according to the invention.
FIGS. 2D and 2E illustrating an enlarged view of the vertical element of the integrated projector according to the invention.

The elements comprising the voltage limiting system (ballast) are divided into two blocks, the blocks being an integral part of the two vertical elements 2, 3 of the support fork-shaped structure of the projector 1, as schematically shown in FIGS. 1, 2A and 2B.

The integrated ballast support of the present invention also includes a projector switching on/off button 11, an outward shielding 15, and an input circuit 13, having a power factor correction circuit 14. See FIGS. 2C-2E.

The vertical elements 2, 3 of the fork-shaped structure are provided with a quick coupling system, for coupling and de-coupling from the projector. The quick coupling system, for coupling and de-coupling from the projector is comprised of the power connector 6 and connector 7 as shown in FIG. 1.

Bearing in mind that projector 1, containing the lamp, is ventilated by natural convection and designed to upwardly convey the hot air flow, the electronic components will never be influenced by the large thermal dissipation of the lamp.

Further, dissipating elements on which the power electronic components are mounted are, in any case, placed in such a way to guarantee an optimum thermal dissipation of the voltage limiting system (ballast).

By the solution suggested according to the present invention, that, as discussed above, provides the integration of all the elements necessary for the proper operation of the discharge lamp, significant advantages are obtained with respect to devices having separated elements (separated projector, ballast and interconnection cable).

First, the solution suggested according to the present invention can be applied to each kind of projector with each kind of optical system (Fresnel, Par, Softlight, Diffusion, etc.).

Second, the solution allows standardization of the electrical connection and distribution system since it would not be necessary to use multiple conductor interconnection cables or provide multipolar cables, even with large power discharge lamps up to 18 kW. The new system allows the use of standard cables and distribution systems which are easily available and inexpensive.

As a result, limits presently imposed on the projector with a separated ballast are overcome, imposing on the various manufacturers to specify a maximum length of the interconnection cables between the ballast and the projector (maximum length indicated by most manufacturers is equal to 100 m). Since the above limitations are not imposed by the present invention, it is possible to hypothesize use and applications not previously taken into consideration.

The present invention has an optimum operation of the voltage powering and limitation device that is not limited by a variable load due to its integration with, and therefore proximity to, the projector. Furthermore, dissipating elements, on which the power electronics are mounted, carry out their function with a higher efficiency with respect to a separated ballast laid down on the ground, since the projector according to the present invention, as the standard projector, is used at a certain height from the ground. This makes it easier to create an air flow about the dissipating elements, which is not obtained with the dissipating elements laid down on the ground, thus optimizing the cooling effect.

Another advantage of the solution according to the present invention is the improvement of the electromagnetic compatibility of the whole device. In fact, while in the systems having a separated ballast and projector, when an electronic ballast is used, it is very difficult to shield the interconnection cables that are crossed by high, square wave form voltages, so that users often must create passages dedicated to this kind of connection, causing an increase of working time, difficulty and increased costs.

In contrast, the present invention solves this problem since each electric power value, different from the supply source, is generated from inside the product, and the product is suitably shielded outward.

By the inventive solution, a power factor correction circuit 14 is obtained. The voltage limiting system included inside the inventive projector provides an input circuit having a correction of the power factor (PFC). Therefore, the device does not introduce appreciable harmonic distortions on the power supply and makes it easier to size the distribution systems. In distribution systems divided in three star phases (for example: 380V between each phase, 220V between phase and neutral phase), due to the power factor correction circuit 14, it is not necessary to oversize the conductor to neutral if systems suitably divided on the three phases are supplied (balancing of the loads). This feature is noticeably advantageous even when using power units to supply these systems.

An evident, and very important advantage of the present invention, is the reduction of space, dimensions and weights. Integration of the ballast of the projector allows a significant reduction in the weight and the dimensions thereof with respect to an equivalent standard system having a separated projector, ballast and cable.

This feature is important for transport and storage of lighting equipment. With respect to lighting equipment having discharge lamps on provisional structures, it is possible to transport more than one apparatus by the same means due to the reduction of volume and weight. It is also possible to store the equipment in small areas. Furthermore, this feature can be appreciated by the equipment rental companies that rent equipment to movie or television production companies.

The present invention is also more reliable than conventional projectors due to a significant reduction of the number of movable electrical connections, more optimum operating conditions (both thermal and electric conditions) of the electronics, electromagnetic shielding outward and the reduction of connection errors and compatibility errors between the ballast and projector present in the conventional systems.

It is possible to transform a conventional system provided with separated ballasts and interconnection cables to a system according to the present invention. The new arrangement provides the ballast in the projector support (fork-shaped structure) and can be applied to products already available on the market.

Among the features of the projector according to the present invention, is the ease of assembling and disassembling the fork-shaped structure/ballast group from the projector body, for high power projectors, in order to simplify the maneuverability of less heavy objects.

Assembling and disassembling operation is accomplished by a mechanical quick release system to easily couple or separate the fork-shaped structure/ballast group from the projector body and by a quick operating connector for the electric parts.

Furthermore, the system is noiseless, as it avoids the use of fans, thus preventing the generation of acoustic noise.

Conventional systems having a separated ballast, usually laid down on the ground, employ forced ventilation dissipation combined with aluminium radiators due to the low efficiency that the latter give in the absence of a light air flow. Conventional systems, when brand new, are noiseless; but after some time, and after the components are used in dusty, humid conditions and exposed to wide thermal variation environments, fans become noisy. However, noiselessness is very important for many kinds of use, such as in the movie and television field, where the image being recorded often occurs at the same time of the image recording.

In conventional systems, acoustic noise problems often occur, requiring users to put the ballast far from the set, bearing in mind the limited length of the interconnection cables and the increase in preparation time and cost.

It can be further easily understood that a significant reduction of direct costs, as well as light arrangement costs and their management at the storing and transport level (indirect costs) are obtained.

The solution according to the present invention suggests a new technological approach reducing the manufacture of many mechanical and electrical parts, eliminating very expensive components, such as, multipolar connectors according to army rules, very flexible multipolar interconnection cables, forced ventilation systems and their management, etc.

From the user point of view, the system according to the invention suggests a working procedure completely different and innovative with respect to the present one, improving the speed of light arrangement preparation, safety, simplicity and low cost of the electric distribution, all features having a great economic and efficiency value.

Finally, remarkable advantages cannot be ignored for the handling and storing of these new systems with respect to the conventional systems.

The present invention has been described for illustrative but not limiting purposes, according to its preferred embodiments, but it is to be understood that modifications and/or changes can be introduced by those skilled in the art without departing from the relevant scope as defined in the enclosed claims.

I claim:

1. An integrated projector for discharge lamps comprising:

a projector, including a discharge lamp, a support structure for said projector, said support structure having two substantially vertical elements, provided laterally with respect to the projector and comprising a ballast, and a horizontal arm, joining said two substantially vertical elements, wherein said horizontal arm houses electrical connection cables of the various components of the ballast provided in said two substantially vertical elements, and a main power supply, wherein between one of said two substantially vertical elements of the support structure and the projector, an electrical connection is provided, and wherein the two substantially vertical elements are laterally spaced from each other on opposite sides of the discharge lamp and directly mounted on the sides of the projector.

2. The integrated projector for discharge lamps according to claim 1, wherein each of said two substantially vertical elements comprises a radiator for cooling the device.

3. The integrated projector for discharge lamps according to claim 1, wherein a projector switching on/off button is provided.

4. The integrated projector for discharge lamps according to claim 1, wherein an outward shielding is provided around the components of the ballast.

5. The integrated projector for discharge lamps according to claim 1, wherein an input circuit having a power factor correction circuit board is provided.

6. The integrated projector for discharge lamps according to claim 1, wherein said elements of the support structure are provided with a quick coupling system, for coupling and de-coupling from the projector.

7. The integrated projector for discharge lamps according to claim 5, wherein the power factor correction circuit board is housed in an outward shielding.

* * * * *